United States Patent [19]

Killop

[11] Patent Number: 4,712,408

[45] Date of Patent: Dec. 15, 1987

[54] COARSE PITCH SPLINE ROLLING

[75] Inventor: James T. Killop, Warren, Mich.

[73] Assignee: Anderson-Cook, Inc., Fraser, Mich.

[21] Appl. No.: 928,701

[22] Filed: Nov. 10, 1986

Related U.S. Application Data

[63] Continuation of Ser. No. 779,260, Sep. 23, 1985, abandoned, which is a continuation of Ser. No. 358,178, Mar. 15, 1982, abandoned.

[51] Int. Cl.[4] ..... B21H 5/00

[52] U.S. Cl. ..... 72/88; 72/95

[58] Field of Search ..... 72/88, 90, 469, 102–105, 72/108, 95; 29/159.2

[56] References Cited

U.S. PATENT DOCUMENTS

| | | | |
|---|---|---|---|
| 395,024 | 12/1888 | Williams | 72/95 |
| 428,498 | 5/1890 | Laundry et al. | 72/469 |
| 440,763 | 11/1890 | Simonds . | |
| 1,088,001 | 2/1914 | Whitcomb | 74/422 |
| 1,727,984 | 9/1929 | Johnson | 74/422 |
| 2,487,553 | 11/1949 | Hunz | 74/422 |
| 2,994,237 | 8/1961 | Pelphrey | 72/469 |
| 3,015,243 | 1/1962 | Drader | 72/469 |
| 3,043,169 | 7/1962 | McCardell . | |
| 3,084,572 | 4/1963 | Starck . | |
| 3,183,697 | 5/1965 | McCardell | 72/88 |
| 3,793,866 | 2/1974 | Anderson et al. | 72/88 |
| 3,804,006 | 4/1974 | Maquignaz et al. | 72/469 |
| 3,857,273 | 12/1974 | Miller | 72/469 |
| 3,862,567 | 1/1975 | Hildreth | 72/469 |
| 4,206,535 | 6/1980 | Roth | 72/88 |
| 4,270,404 | 6/1981 | Murakoshi et al. | 74/89.17 |
| 4,383,428 | 5/1983 | Jungesjo | 72/88 |

OTHER PUBLICATIONS

Boston Gear, Power Transmission Equipment & Component Machine Parts, Boston Gear Works, Div. of Murray Co. of Texas, Catalog 55, 1950, pp. 35–71, 358–363.

*Primary Examiner*—Daniel C. Crane

*Attorney, Agent, or Firm*—Reising, Ethington, Barnard, Perry & Milton

[57] ABSTRACT

A machine (10) disclosed incorporates spline rolling apparatus (12) having a pair of racks (30) of a construction that permits precise rolling of coarse pitch splines (45). Each rack (30) includes a toothed forming face (32) and a flat base surface (58) as well as a flat side support surface (60) that cooperatively provide accurate location of the rack during the spline rolling. Teeth (56) spaced along the toothed forming face have tapered ends such that a rotatably supported workpiece (14) which is moved axially between the racks (30) during reciprocal driving thereof is progressively formed with the coarse pitch splines (45) without excessively loading the teeth. Both straight and curved tapers are disclosed, preferably on both ends of each tooth, and the teeth are disclosed as being both perpendicular to the direction of the rack to roll straight splines as well as angularly with respect thereto to roll helical splines. A drive mechanism for slides (27) on which the racks (30) are carried includes a pair of rotary hydraulic motors (82) which drive a gear drive train (86) for moving the rack slides.

8 Claims, 7 Drawing Figures

COARSE PITCH SPLINE ROLLING

This application is a continuation of application Ser. No. 779,260, filed Sept, 23, 1985, now abandoned, which is a continuation of Ser. No. 358,178 filed Mar. 15, 1982 now abandoned.

TECHNICAL FIELD

This invention relates to rolling of splines having a coarse pitch, i.e. less than 16 splines per inch along the pitch circle of the splines.

BACKGROUND ART

The prior art discloses numerous machines including a pair of elongated forming racks for rolling splines or teeth in a round workpiece. With this type of machine, driven movement of the pair of racks in opposite directions from each other engages forming teeth of the racks with the round workpiece at diametrically opposite locations to form splines in the workpiece. The splining is conventionally completed during a single stroking action of the dies such that the length of the splines formed is equal to the width of rack tooth engagement with the workpiece, which is normally equal to the width of the forming racks. Usually the complete splining operation is performed by a single stroking action of the racks from a first end-to-end position through an overlapping relationship and to a second end-to-end position. Unloading can be performed in the second end-to-end position or after reverse movement of the racks back to the first end-to-end position. Furthermore, it is also possible to perform splining of long splines having a greater length than the width of the racks by two or more strokes with axially indexing of the workpiece between the strokes.

Spline rolling as described above cannot be performed when a coarse pitch is involved, i.e. less than 16 splines per inch along the pitch circle, since the amount of material movement produces too great a load on the rack teeth. As such, coarse pitch splines have previously been formed by a suitable metal removal operation such as broaching or hobbing, etc. However, such metal removal operations are much more time consuming and expensive than spline rolling.

U.S. Pat. No. 3,043,169 discloses apparatus for pressure forming teeth or splines on a workpiece by a pair of elongated tools having round cross sections with teeth spaced along their lengths. Opposite ends of each tool are supported by associated holders on slidable bases and are driven in a spaced relationship to each other in a reciprocal manner as a rotatable workpiece is moved along its axis of rotation between the tools. Wedges on each slidable base engage the associated tool intermediate its ends with line contacts during the splining. After the splining, the round tools are rocked away from the wedges to permit unloading of a splined workpiece. Also, each of the slidable bases is driven by an extendable and retractable hydraulic cylinder which can tend to buckle in the extending mode of movement such that the splining is not performed as accurately as may be desired.

DISCLOSURE OF INVENTION

An object of the present invention is to provide precise rolling of splines of a coarse pitch, i.e. less than 16 splines per inch along the pitch circle.

In carrying out the above object, a pair of racks constructed in accordance with the present invention are driven in a reciprocal manner as a round workpiece supported for rotation is moved along its rotational axis between the racks. Engagement of the racks with the workpiece at diametrically opposite locations rolls splines on the workpiece as the reciprocal driving of the racks and the axial movement of the workpiece take place. This operation forms the splines gradually to permit coarse pitch splines to be pressure formed as opposed to forming thereof by a metal removal operation.

The rack constructed in accordance with the invention to roll splines of a coarse pitch includes an elongated metallic body having a toothed forming face along its length. The forming face includes generally straight teeth spaced along the length thereof and having a linear pitch of less than 16 teeth per inch. The metallic body also includes a flat base surface that faces in the opposite direction as the toothed forming face in a parallel relationship thereto, and the metallic body also includes a pair of side surfaces that extend between the toothed forming face and the base surface. One of the side surfaces has a flat shape defining a side support surface that cooperates with the flat base surface to provide mounting of the rack during use. Each tooth of the rack has a tapered end adjacent the other side surface in order to permit the coarse pitch spline rolling to be performed by a pair of the racks.

The straight teeth of the forming face are disclosed extending perpendicularly to the elongated direction of the rack body to provide rolling of straight splines and are also disclosed as extending angularly to the elongated direction of the rack body to provide rolling of helical splines. Both straight and curved tapers on the tooth ends are disclosed. While the straight taper on the tooth ends can more conveniently be formed than the curved taper and would thus normally be used, the curved taper on the tooth ends allows rolling of coarse pitch splines into close proximity to a radial flange and would thus be used when such splining is required. Regardless of which tapered shape is utilized, both ends of each tooth are preferably tapered to strengthen the full profile of the tooth therebetween where the full forming takes place. Thus, each tooth includes a straight shape tapering adjacent its flat side support surface and its other side surface or includes a curved shape tapering adjacent its flat side support surface and its other side surface.

Both of the side surfaces of the metallic rack body are preferably flat in the preferred construction and extend in a spaced and parallel relationship to each other. Each flat side surface extends between the toothed forming face and the base surface in a perpendicular relationship thereto such that the cross section of the body is generally rectangular. At its opposite ends, the metallic body includes a pair of end retention lugs for locating and securing the flat base surface of the body during use. A plurality of retention bolts of the rack body extend between the side surfaces thereof to receive retention bolts that locate and secure the flat side support surface thereof during use.

Apparatus for rolling splines of a coarse pitch in accordance with the invention includes a pair of spaced slides mounted for movement in a parallel relationship to each other. Each slide includes a rack box having a flat base mounting surface that faces toward the other rack box in a parallel relationship to its flat base mounting surface. Each rack box also includes a flat side mounting surface extending from the base mounting surface thereof in a perpendicular relationship thereto and facing in the same direction as the side mounting surface of the other rack box. A pair of the racks are respectively supported by the pair of rack boxes, with the flat base surfaces of the racks respectively engaged with the flat base mounting surfaces of the rack boxes, and with the flat side support surfaces of the racks respectively engaged with the flat side mounting surfaces of the rack boxes. A drive mechanism of the apparatus includes a pair of rotary hydraulic motors for respectively driving the pair of slides as well as the racks thereon in a reciprocal manner. A workpiece mount of the apparatus rotatably supports a workpiece between the racks and moves the workpiece along the axis of rotation thereof in a direction opposite to the direction toward which the side mounting surfaces of the rack boxes face such that the racks roll form splines in the workpiece.

The engagement of the flat base surfaces and the flat side support surfaces of the racks with the flat base mounting surfaces and the flat side mounting surfaces of the rack boxes on the slides provides accurate location of the rack teeth under loading and thereby insures precise spline forming. The rotary hydraulic motors utilized to reciprocally drive the slides provides accurate control of the movement in both direction.

A machine incorporating the apparatus for rolling coarse pitch splines includes upper and lower bases defining a workspace in which the spline rolling is performed. The upper and lower bases respectively include upper and lower slideways on which the slides carrying the racks are supported for the reciprocal movement that performs the splining. Each of the pair of rack boxes on the slides includes a pair of end clamps for securing the pair of end retention lugs of the associated rack such that the rack body is clamped against the flat base mounting surface of the associated rack box. A plurality of retention bolts associated with each rack extend through the retention bolt holes thereof to provide clamping of the metallic rack body against the side mounting surface of the associated rack box.

The machine incorporating the coarse pitch spline rolling apparatus also preferably includes a gear drive train that drives the pair of slides along the slideways on the upper and lower bases. The pair of rotary hydraulic motors both drive the gear drive train and the pair of slides to perform the splining. The workpiece mount of the machine rotatably supports the workpiece within the workspace defined by the upper and lower bases at a location between the racks such that the reciprocal driving of the racks performs the splining as the workpiece mount moves the workpiece axially along its axis of rotation.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
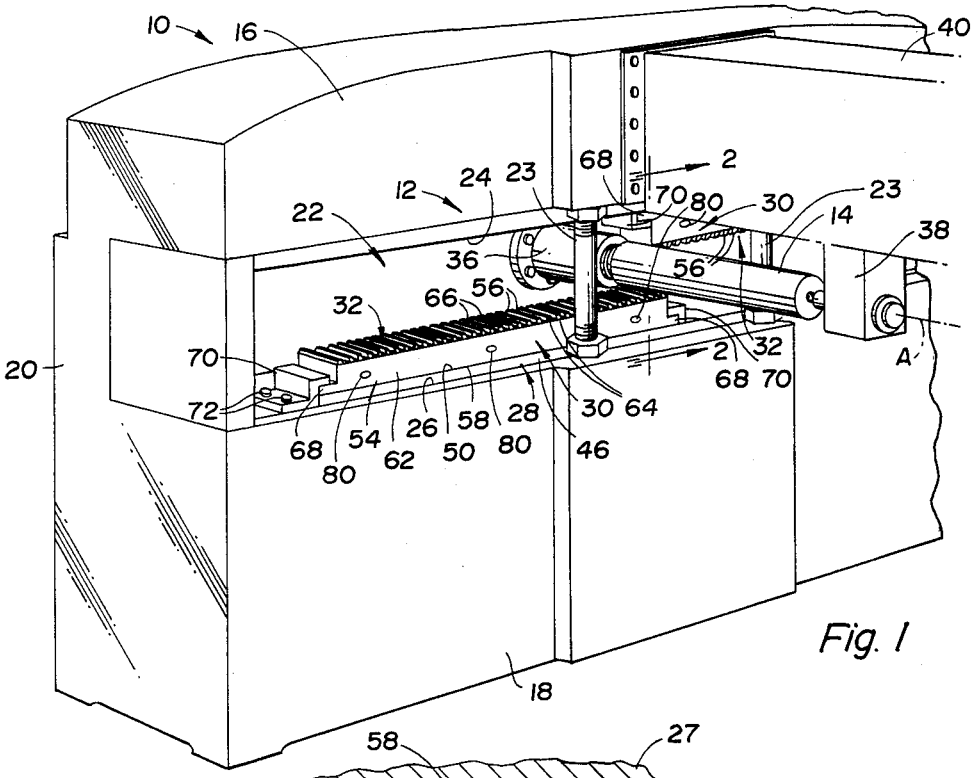
FIG. 1 is a perspective view of a machine including coarse pitch spline rolling apparatus that includes a pair of racks constructed in accordance with the present invention.

Referring to FIG. 1 of the drawings, a machine 10 constructed in accordance with the present invention includes apparatus 12 for rolling splines of a coarse pitch on the round outer surface of a workpiece 14. Machine 10 includes upper and lower bases 16 and 18 that project forwardly from a connecting portion 20 to define a workspace 22 in which the splining is performed. A pair of tie rod connections 23 extend between bases 16 and 18 at their front ends to limit deflection therebetween as the spline rolling is per- formed.

As seen in FIG. 1, the upper and lower bases 16 and 18 of the machine 10 respectively include slideways 24 and 26 that extend parallel to each other in a vertically spaced relationship. As is hereinafter more fully described, a pair of slides 27 (FIGS. 2 and 3) of the machine are respectively supported on the upper and lower slideways 24 and 26 shown in FIG. 1 for movement in a parallel relationship to each other. Slides 27 support a pair of rack boxes 28 on which a pair of racks 30 are respectively mounted in a spaced relationship to each other above and below the workpiece 14. Each rack 30 includes a toothed forming face 32 for forming the splines as the slides 27 are driven in a reciprocal manner by a drive mechanism 34 of the machine as illustrated in FIG. 3.

Figure 2:
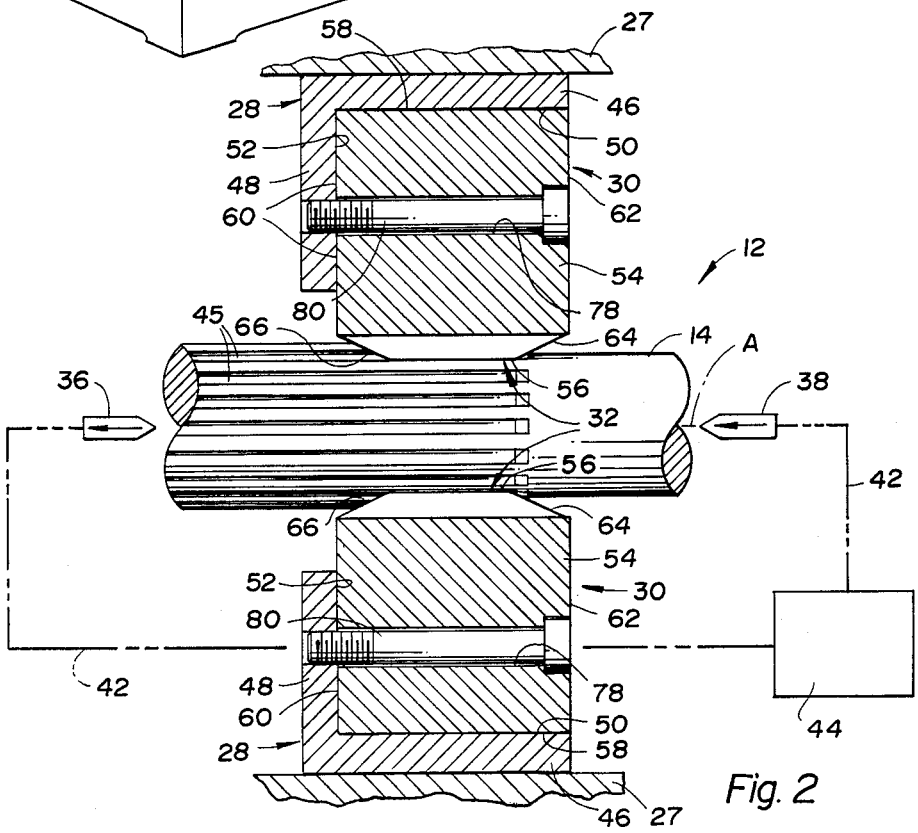
FIG. 2 is a sectional view taken generally along line 2—2 of FIG. 1 through the racks and illustrates straight tapers on the ends of the teeth thereof in order to form straight splines of a coarse pitch in accordance with the invention.

Machine 10 also has a workpiece mount which, as seen in FIGS. 1 and 2, includes a movable headstock support 36 and a movable tailstock support 38. The headstock support 36 is preferably mounted on the connecting portion 20 between the machine bases within the workspace 22 and the tailstock support 38 is mounted on the lower side of an overarm 40 that extends outwardly from the upper base 16 of the machine. Headstock support 36 and tailstock support 38 cooperate to rotatably mount the workpiece 14 about a rotation axis A thereof as the splining is performed during the reciprocal driving of the racks by the machine drive mechanism. Both the headstock support 36 and the tailstock support 38 are driven by a suitable drive as schematically indicated at 42 in FIG. 2 under the operation of an actuator 44 in order to move the rotatable workpiece 14 axially along its axis of rotation in a direction toward the left. Such axial movement of the workpiece 14 constitutes a feeding action such that the toothed forming faces 32 of the reciprocating racks 30 progressively form splines 45 in the workpiece 14. After the splining has been performed for the required axial length, the racks 30 are driven in their end-to-end relationship illustrated in FIG. 1 in order to permit removal of the splined workpiece and commencement of the next cycle.

Figure 3:
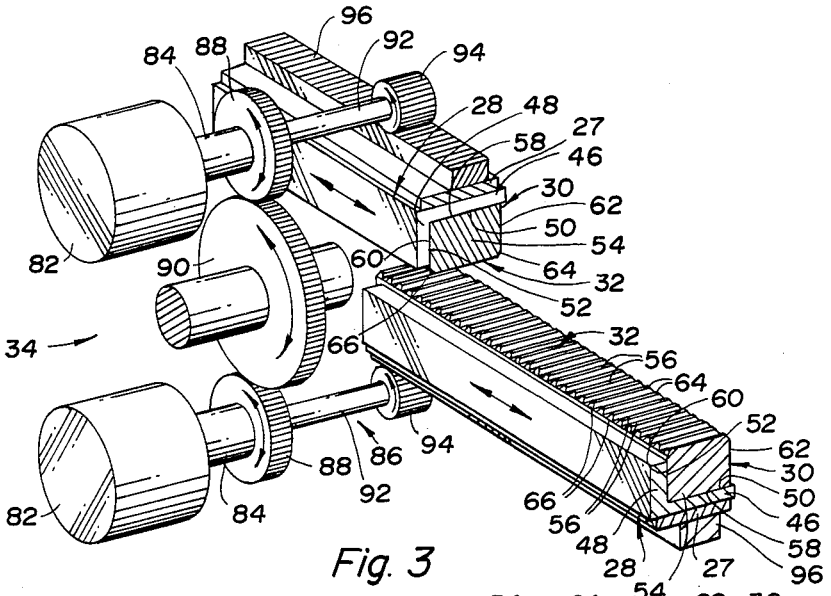
FIG. 3 is a perspective view illustrating the drive mechanism of the machine shown in FIG. 1.

As seen in FIGS. 2 and 3, each of the rack boxes 28 has an L shape including a base leg 46 and a slide leg 48. The base leg 46 of each rack box 28 defines a flat base mounting surface 50 that faces toward the other rack box in a parallel relationship to its base mounting surface. The side leg 48 of each rack box 28 defines a flat side mounting surface 52 that extends from the associated base mounting surface 50 in a perpendicular relationship thereto and faces in the same direction as the side mounting surface of the other rack box. Both side mounting surfaces 52 of the rack boxes 28 face toward the right as viewed in FIG. 2 in the opposite direction as the direction toward which the workpiece 14 is moved during the splining operation.

Figure 7:
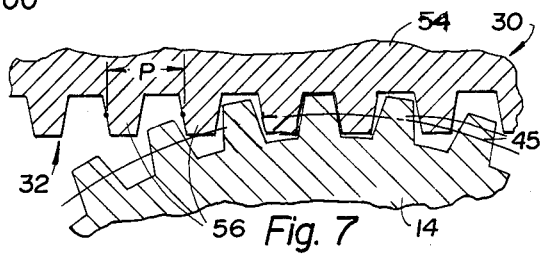
FIG. 7 is a schematic view illustrating the engagement between a rack and a workpiece during the spline forming operation.

As seen in both FIGS. 1 and 2, each rack for rolling splines of a coarse pitch in accordance with this invention includes an elongated metallic body 54 that is made of a suitable tool steel. The toothed forming face 32 of each rack body 54 extends along the length thereof and includes generally straight teeth 56 of a shape which, as seen in FIG. 7, is conjugate to the shape of the splines 45 to be formed in the workpiece 14. The rack teeth 56 have a linear pitch of less than 16 teeth per inch, i.e. along each one inch length of the rack there are less than 16 intervals "P" as seen in FIG. 7 from each tooth to a corresponding location on the next tooth. Each metallic body 54 also includes a flat base surface 58 that extends parallel to the toothed forming face 32 thereof facing in the opposite direction in engagement with the flat base mounting surface 50 on the associated rack box 28. Each metallic body 54 also includes a pair of side surfaces 60 and 62 that extend between its toothed forming face 32 and base surface 58. The one side surface 60 has a flat shape and constitutes a side support surface that engages the side mounting surface 52 of the associated rack box 28 in the mounted relationship shown. Each tooth 56 has a tapered end 64 adjacent the other side surface 62 of the rack body 54.

Gradual splining is performed along the length of the workpiece 14 by the reciprocal driving of the racks 30 and the simultaneous axial movement of the rotating workpiece such that the rack teeth 56 are not loaded to the extent that would be present if the splines were rolled in a conventional manner by a single stroking action. Furthermore, the engagement of the flat surfaces 58 and 60 on the rack bodies 54 with the flat mounting surfaces 50 and 52 on the associated rack boxes 28 provides surface-to-surface support in order to accurately locate the racks along their entire lengths in a manner that promotes precise spline forming. It should also be noted that splines with a circular pitch of 16 or more splines per inch would not be roll formed in the manner herein disclosed since the material movement with such splining is not sufficiently great to load the teeth to an extent necessitating the more involved rolling operation of this invention.

The construction of the racks 30 illustrated in FIGS. 1 and 2 includes straight teeth 56 that extend perpendicularly to the elongated direction of the associated rack body 54 to provide rolling of straight splines that extend parallel to the central axis of the workpiece 14. The tapered end 64 of each tooth 56 adjacent its side surface 62 has a straight shape. Each rack tooth 56 also preferably includes another straight tapered end 66 adjacent its flat side support surface 60. Tapered ends 64 and 66 on the teeth 56 can be readily formed by grinding along the length of the rack. With tapers on both ends of each rack tooth 56, the central tooth portions where full penetration takes place are supported in part by their adjacent ends which are not loaded to thus reduce deflection and thereby insure precise splining.

As seen in FIG. 1, each rack body 54 includes a pair of end retention lugs 68 respectively adjacent its opposite ends. A pair of end clamps 70 of each rack box 28 are secured thereto by attachment bolts 72 in order to clamp the rack with its flat base surface 58 engaged with the flat base mounting surface 50 on the rack box in surface-to-surface engagement. The one clamp 70 of each rack box 28 closest to the rotational axis A includes an unshown positioning bolt that extends along the direction of movement and engages the adjacent rack end. Adjusting rotation of this positioning bolt properly locates the rack along the length of the rack box prior to the securement thereof by the clamps.

As seen in FIG. 2, the side surface 62 as well as the side surface 60 of each rack body 54 are both of a flat shape extending in a spaced and parallel relationship to each other along the length of the rack. Between the ends of each rack 30, the rack body 54 includes a plurality of retention bolt holes 78 that respectively receive a plurality of retention bolts 80 for engaging the flat side support surface 60 of the rack body with the flat side mounting surface 52 on the associated rack box 28. It should be mentioned that the retention bolt holes 78 are somewhat larger than the bolts 80 in order to permit the lengthwise adjustment of the racks as described above prior to securement of the racks to the rack boxes. After such adjustment, the clamps 70 and the retention bolts 80 are tightened so as to cooperate in securing the racks 30 to their associated rack boxes 28.

With reference to FIG. 3, the machine drive mechanism 34 for driving slides 28 and the racks 30 mounted thereon is of the type disclosed by U.S. Pat. No. 3,793,866 and includes a pair of rotary hydraulic motors 82 which are respectively located within the upper and lower bases of the machine. Each hydraulic motor 82 has an output 84 driving a common gear train 86 of the drive mechanism. Outputs 84 are each connected to an associated gear 88 which are meshed with a common synchronizing gear 90. A pair of upper and lower shafts 92 connect the gears 88 with a pair of upper and lower gears 94 which are respectively meshed with driving racks 96 secured to the pair of slides 27. Opposite rotational driving of the rotary hydraulic motors 82 through their outputs 84 and the gear drive train 86 provides reciprocal driving of the forming racks 30 in a manner which provides precise forming of coarse pitch splines by the racks and machine apparatus herein described. Use of the rotary hydraulic motors 82 as opposed to hydraulic cylinders provides more precise control with the reciprocal driving involved. This is because hydraulic cylinders tend to buckle during their extending strokes and thus do not provide accurate control in both directions as can be accomplished with the rotary hydraulic motors.

Figure 4:
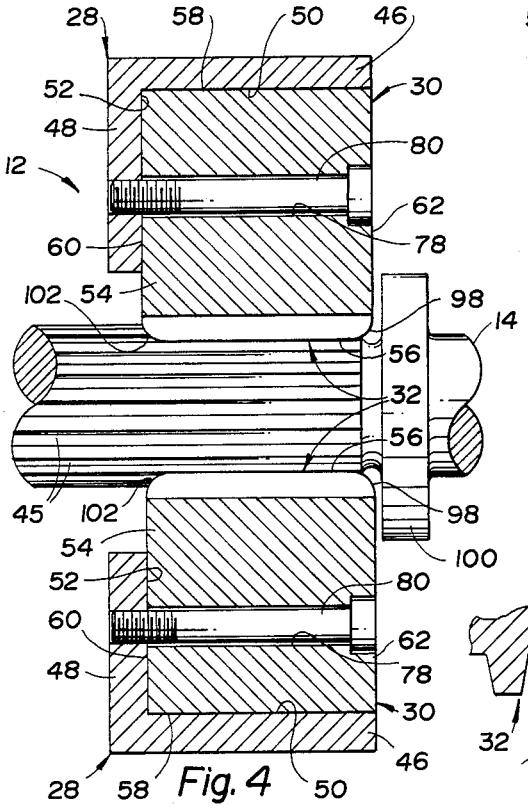
FIG. 4 is a sectional view similar to FIG. 2 but illustrating another embodiment of the racks which have teeth whose ends define rounded tapers in order to permit forming of straight splines of a coarse pitch adjacent a flange on the workpiece.

With reference to FIG. 4, the coarse pitch spline rolling apparatus 12 is illustrated with another embodiment of the racks 30 which, except as will be noted, are identical to the previously described racks such that the previous description is applicable thereto and no repetition thereof is necessary. The difference between this rack embodiment and the previously described one is that each tooth 56 thereof has a tapered end 98 of a curved shape adjacent its side surface 62. This construction permits the forming of splines 45 into relatively close proximity with the adjacent axial surface of an annular flange 100 on the workpiece 14. The end of each tooth 56 adjacent its side surface 60 also preferably has a tapered end 102 of a curved shape. A contoured grinding wheel can be utilized to grind the curved shapes of the tapered ends 98 and 102 on the teeth 56 by feeding the rack lengthwise in a generally tangential relationship to the contoured wheel. Teeth 56 of this embodiment extend perpendicularly to the elongated axis of the associated rack such that the splines 45 rolled have a straight shape extending parallel to the rotational axis of the workpiece in the same manner as the previously described embodiment.

Figure 5:
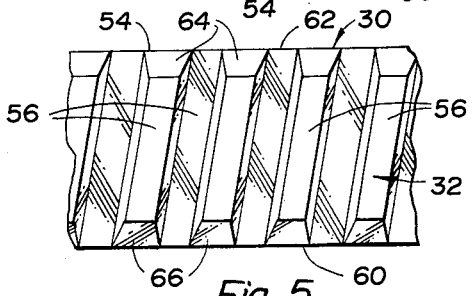
FIG. 5 is a plan view of the toothed forming face of another rack embodiment which includes straight end tapers as in FIG. 2 but has angularly extending teeth in order to form helical splines of a coarse pitch on a workpiece.

With reference to FIG. 5, a further embodiment of the rack 30 is illustrated as including teeth 56 that extend angularly with respect to the elongated direction of the rack so as to roll helical splines on a workpiece in cooperation with another like rack in accordance with the coarse pitch spline rolling operation previously described. Angular teeth 56 of this embodiment have tapered ends 64 of a straight shape adjacent the side surface 62 where the spline forming begins and also have tapered ends 64 of a straight shape adjacent the other side surface 60. In all other respects, this rack embodiment is the same as the rack embodiment described in connection with FIGS. 1–3 and no repetition of the description is thus necessary.

Figure 6:
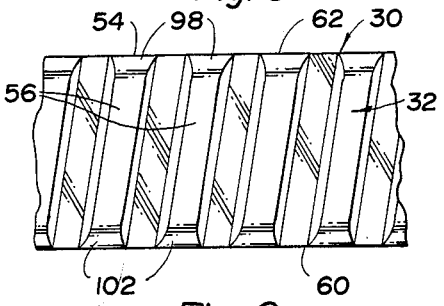
FIG. 6 is a plan view of the tooth forming face of a further rack embodiment which has rounded end tapers similar to the embodiment of FIG. 4 but with angular teeth for forming helical splines of a coarse pitch on a workpiece.

With reference to FIG. 6, a still further embodiment of the rack 30 is illustrated with teeth 56 that extend angularly relative to the elongated direction of the rack in the same manner as the rack embodiment of FIG. 5 to form coarse pitch splines of a helical configuration. However, the angular teeth 56 of this embodiment have tapered ends 98 of a curved shape adjacent the side surface 62,in the same manner as the previously described rack embodiment of FIG. 4, in order to permit splining into close proximity with an adjacent flange. Furthermore, the angular teeth 56 have tapered ends 102 of a curved shape adjacent the side surface 60. The spline rolling operation performed by a pair of these racks with the angular teeth having curved tapered ends are in all other respects the same as the previously described embodiment of FIG. 4 such that no repetition of this description is necessary.

While the best modes for carrying out the invention have been described in detail, those familiar with the art to which this invention relates will recognize various alternative designs and embodiments for practicing the present invention as defined by the following claims.

What is claimed is:

1. Apparatus for rolling splines of a coarse pitch comprising: a pair of rack boxes; a pair of racks fixedly mounted on said rack boxes moveable reciprocatingly on a path, each of said racks including a toothed forming face and flat side surfaces, said forming faces each including teeth spaced along the length thereof and having a linear pitch of less than 16 teeth per inch, said teeth of the rack bodies each including an origin and elongated sides upwardly tapering from said origin and extending perpendicular relative to the path and having a substantially flat top surface and a tapered end extending from the tooth origin at the side surface of the rack to the top surface; drive means for respectively driving said pair of racks thereon in a reciprocating manner; and workpiece mount means for rotatably supporting a workpiece between said racks and moving the workpiece along the axis of rotation thereof as said drive means drives said pair of racks in a reciprocating manner in a direction of said teeth having said tapered end such that the racks roll form splines progressively along the length of the workpiece.

2. An apparatus as set forth in claim 1 including a pair of spaced slides mounted for movement in a parallel relationship to each other, each of said slides including a rack box having a flat base mounting surface that faces toward said other rack box in a parallel relationship to said flat base mounting surface thereof, each of said racks including an elongated metallic body including said toothed forming face, each of said metallic bodies including a flat base surface being respectively engaged with said base mounting surfaces of said pair of rack boxes.

3. An apparatus as set forth in claim 2 wherein each of said rack boxes includes a flat side mounting surface extending from said base mounting surface thereof and facing the same direction as said side mounting surface of the other of said rack boxes, each of said metallic bodies further including a pair of flat side surfaces that extend in a spaced and parallel relationship to each other, one of said side surfaces of each of said metallic bodies having a flat shape defining a side support surface being respectively engaged with said side mounting surfaces of said pair of rack boxes, said workpiece mount means moving the workpiece in a direction opposite to said direction toward whioh said side mounting surfaces of said rack boxes face.

4. An apparatus as set forth in claim 2 including upper and lower bases defining a workspace and respectively including upper and lower slideways, said slides being respectively supported by said upper and lower slideways for movement in a parallel relationship to each other.

5. An apparatus as set forth in claim 4 wherein each of said rack boxes include a pair of end clamps and a plurality of retention bolts, each of said metallic bodies including a pair of retention lug respectively clamped against said flat base mounting surface of an associated one of said rack boxes by said end clamps thereof, each of said metallic bodies further including a plurality of retention bolt holes extending between said side surfaces thereof for receiving said retention bolts of said associated rack box to clamp said metallic body against said side mounting surface of said rack box.

6. An apparatus as set forth in claim 2 wherein said drive means includes a pair of rotary hydraulic motors.

7. An apparatus as set forth in claim 6 wherein said drive means includes a gear train operatively connected to said slides for driving said pair of slides along said slideways on said upper and lower bases.

8. A method of rolling splines of a coarse pitch along the length of a workpiece comprising the steps of: continually reciprocating a pair of spaced racks having flat side surfaces wherein each rack has a substantially square cross section and includes a toothed forming face along the length thereof engaging the workpiece therebetween and has a linear pitch of less than 16 teeth per inch, the teeth having elongated sides extending perpendicularly relative to the length of the rack and having a substantially flat top surface and having at least one side having a tapered end and flat elongated sides, supporting the workpiece to rotate between racks as the racks reciprocate to form splines in one portion of the length of the workpiece, moving the workpiece along its longitudinal axis against the tapered end and along the elongated sides of the substantially flat teeth of the racks in a direction of the tapered end of the teeth as the racks reciprocate to roll form splines progressively along the length of the workpiece and flowing the material of the workpiece forwardly in the direction of movement of the teeth along the workpiece and radially away from the moving tapered end tangentially away from the elongated sides into the formed teeth preventing rearwardly radial flow of the material behind the moving teeth back into the formed spaces formed between the splines.

* * * * *

UNITED STATES PATENT AND TRADEMARK OFFICE

CERTIFICATE OF CORRECTION

PATENT NO. : 4,712,408

DATED : December 15, 1987

INVENTOR(S) : James T. Killop

It is certified that error appears in the above-identified patent and that said Letters Patent is hereby corrected as shown below:

Column 8, Line 35, Claim 3

"whioh" should be --which--.

Column 8, Line 46, Claim 5

"lug" should be --lugs--.

Signed and Sealed this

Thirty-first Day of March, 1992

*Attest:*

*Attesting Officer*

HARRY F. MANBECK, JR.

*Commissioner of Patents and Trademarks*